US006532809B2

(12) United States Patent
Robinson

(10) Patent No.: US 6,532,809 B2
(45) Date of Patent: Mar. 18, 2003

(54) MONITORING EQUIPMENT

(75) Inventor: Kevin Robinson, Buckingham (GB)

(73) Assignee: Assemby Technology & Test, Ltd., London (GB)

( * ) Notice: Subject to any disclaimer, the term of this patent is extended or adjusted under 35 U.S.C. 154(b) by 127 days.

(21) Appl. No.: 09/834,472

(22) Filed: Apr. 13, 2001

(65) Prior Publication Data

US 2002/0007662 A1 Jan. 24, 2002

(30) Foreign Application Priority Data

Apr. 14, 2000 (GB) ..... 0009165

(51) Int. Cl.[7] ..... F02M 65/00

(52) U.S. Cl. ..... 73/119 A; 73/49.7; 137/557; 251/129.2

(58) Field of Search ..... 73/1.72, 49.7, 73/119 A; 123/357, 494; 137/487.5, 488, 557; 251/129.2

(56) References Cited

U.S. PATENT DOCUMENTS 4,509,715 A * 4/1985 Kubach ..... 251/129.2
4,714,998 A * 12/1987 Bussey et al. ..... 73/119 A
5,020,362 A * 6/1991 Hart et al. ..... 73/119 A
5,641,891 A * 6/1997 Frankl et al. ..... 73/1.72
6,260,404 B1 * 7/2001 Aota et al. ..... 73/119 A
6,311,553 B1 * 11/2001 Schoffel et al. ..... 73/119 A

* cited by examiner

*Primary Examiner*—Michael Powell Buiz
*Assistant Examiner*—Ramesh Krishnamurthy
(74) *Attorney, Agent, or Firm*—Blackwell, Sanders, Peper, Martin LLP

(57) ABSTRACT

Monitoring equipment comprising a part which defines a cavity, and input device to input fluid under pressure into the cavity. Mounting devices are provided on the part to enable an engine fuel injector valve or other fluid release device to be connected to the part and to release fluid from the cavity intermittently when the system is in use. Controls are connected to issue a triggering signal to the fluid release device to cause the latter to release fluid from the cavity. A pressure sensor is coupled to the cavity to provide a measure of the pressure within the cavity. The equipment further comprises pressure signal modifying device connected to receive signals from the pressure sensor and the controls and constructed to provide an output signal which is a measure of the pressure of fluid within the cavity at the time the controls issues such a triggering signal, while the effect of signals from the pressure sensor received by the modifying device on the output signal therefrom at other times is obviated.

10 Claims, 4 Drawing Sheets

MONITORING EQUIPMENT

The present invention relates to monitoring equipment comprising a part which defines a cavity, input means to input fluid under pressure into the cavity, mounting means on the said part to enable an engine fuel injector valve or other fluid release device to be connected to the said part and to release fluid from the cavity intermittently when the system is in use, control means connected to issue a triggering signal to the fluid release device to cause the latter to release fluid from the cavity, and a pressure sensor coupled to the cavity to provide a measure of the pressure within the cavity.

Such monitoring equipment is disclosed in our co-pending United Kingdom Patent Application No. 9930120.2 filed on Dec. 21, 1999.

A disadvantage of such equipment is that the pressure as measured by the sensor is given spurious values by virtue of the shock waves following release of fluid from the cavity by the fluid release device.

The present invention seeks to provide a remedy.

Accordingly, the present invention is directed to monitoring equipment having the construction set out in the opening paragraph of the present specification, in which the equipment further comprises pressure signal modifying means connected to receive signals from the pressure sensor and the control means and constructed to provide an output signal which is a measure of the pressure of fluid within the cavity at the time the control means issues such a triggering signal, whilst the effect of signals from the pressure sensor received by the modifying means on the input signal therefrom at other times is obviated.

Advantageously, the input means of the monitoring equipment may include an adjustable flow regulator which serves to regulate the input of fluid under pressure into the cavity.

A substantially constant pressure of fluid within the cavity can be obtained effectively if the adjustable regulator means comprises fluid flow control means coupled to the pressure sensor so that the flow control means effects an increase or a decrease to the flow of fluid into the cavity, thereby to maintain the pressure of the fluid therein at a desired operating pressure.

Preferably, the flow control means comprises an hydraulic amplifier arranged to operate valve means of the flow control means so as to effect such increase or decrease.

An especially fast response to changes of pressure is obtainable if the flow control means comprises a first movable member, transducer means which serves to provide a force which acts on and moves the first movable member in dependence upon the magnitude of an input signal delivered to the flow control means, two inputs connected to deliver pressurised fluid to opposite sides respectively of the first movable member and to opposite sides respectively of a second movable member, and output means from which fluid flows after it has reached the first movable member, in such a manner that movement of the first movable member in a first direction increases the resistance to flow of fluid from one of the two inputs to the said output means, so that pressure of fluid from that input urges the said second movable member in a given direction, whilst movement of the first movable member in a second direction, opposite to the first, increases the resistance to flow of fluid from the other of the said two inputs to the said output means, so that pressure of fluid from that other input urges the said second movable member in another direction opposite to the said given direction, the flow control means further comprising balancing means to balance the movement of the second movable member against the said force, and valve means which are opened to an extent which is dependent upon the position of the second movable member, whereby the extent to which the valve means is opened is dependent upon the magnitude of the input signal, so that the latter effects such increase or decrease.

Advantageously, the pressurised fluid delivered by the said two inputs is the pressurised fluid from the said source.

Preferably, the balancing means comprise a spring.

The valve means of the flow control means is preferably a slide valve, for example a spool valve.

Advantageously, the pressure signal modifying means provides a continuous output signal to the adjustable flow regulator by holding the value it has at the time the control means issues such a triggering signal until the time the control means issues the next such signal.

An example of monitoring equipment embodying the present invention will now be described with reference to the accompanying drawings, in which.

Figure 1:
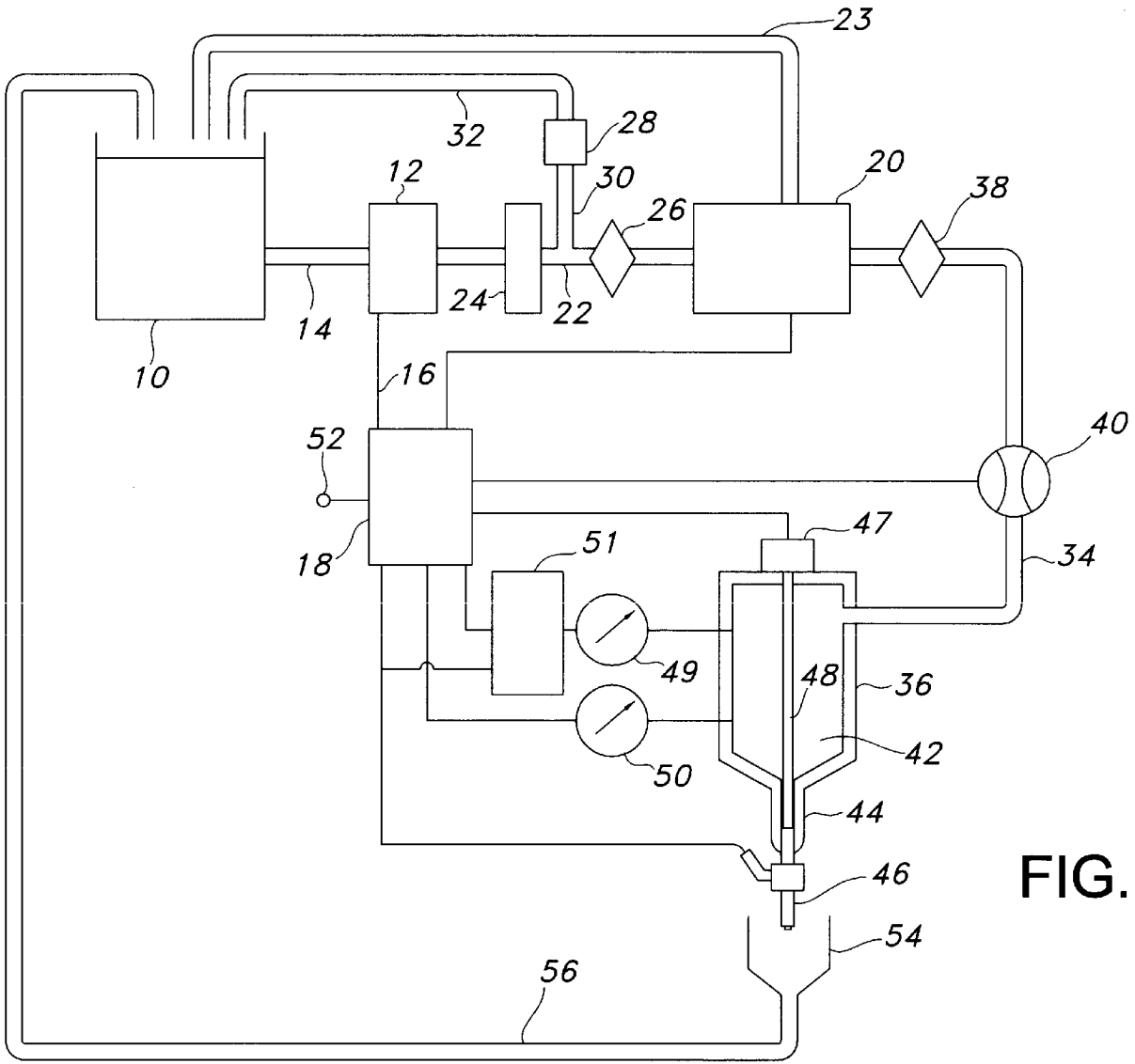
FIG. 1 shows a circuit diagram of the equipment.

The equipment shown in FIG. 1 comprises a tank 10 filled with test fluid. A pump 12 is connected to the tank 10 by way of the test fluid conduit 14. The pump 12 is connected electrically via a lead 16 to be controlled by a control processor 18.

The pump 12 is connected to deliver test fluid under a pressure of up to 400 bar to a precision servo-electro-hydraulic pressure control valve constituting a flow regulator 20 via a test fluid conduit 22. A return line 23 returns some of the test fluid from the regulator 20 back to the tank 10. A temperature controller 24 and a filter 26 are included in the conduit 22 for the purpose of maintaining the temperature of the test fluid and extracting dirt particles from it respectively. There is also a relief valve 28 connected to the conduit 22 via a T-branch 30. The other side of the relief valve 28 is provided with a return line 32 to return excess test fluid to the tank 10.

Continuing downstream from the flow regulator 20, the latter is connected via a further conduit 34 to enable test fluid to pass from the flow regulator 20 to an injector valve test head 36. A filter 38 and a flow meter 40 are connected respectively in the conduit 34 to further clean the test fluid and to provide a measurement of the flow rate of test fluid to the test head 36 respectively.

The test head 36 is hollow so as to provide a test fluid chamber 42 which is in communication with the conduit 34. A connector 44 is provided on the test head 36 to enable an injector valve 46 under test to be connected to the test head in such a fashion as to receive test fluid from the cavity 42. An injector valve adjuster 47 is connected to enable adjustment of the injector valve 46 via an adjustment rod 48.

A pressure sensor 49 and a temperature sensor 50 are positioned to measure the pressure and temperature respectively of the test fluid in the cavity 42. Electrical connections are made respectively from the flow meter 40, the pressure sensor 49 (via a pressure signal modifier 51) and the temperature sensor 50 to inputs of the control processor 18, and electrical connections are made from outputs of the control processor 18 respectively to the pump 12, the flow regulator 20, the injector valve 46 under test, and the injector valve adjuster 47. A further electrical connection is made from the processor 18 to a further input of the pressure signal modifier 51.

A further output 52 from the control processor 18 provides data for display and/or recordal, including in particular cumulative values of the volume of test fluid which is injected through the injector valve 46 per injection.

A collecting vessel 54 is located to receive test fluid released from the injector valve 46, and the return line 56 enables this collected test fluid to be returned to the tank 10.

Figure 2:
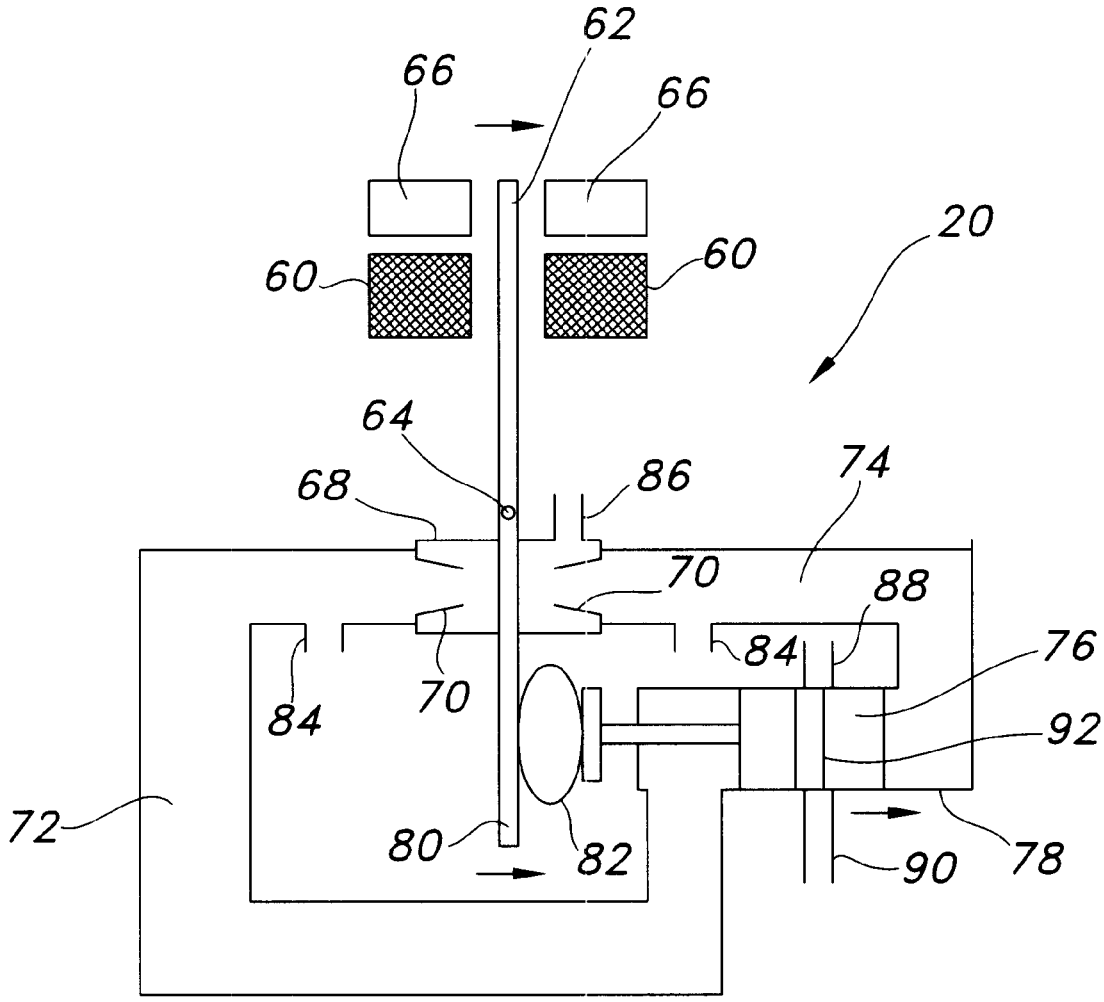
FIG. 2 shows a diagram of flow control means of the equipment shown in FIG. 1.

Further details of the flow regulator 20 are shown in FIG. 2. Such a device is particularly accurate and fast in correcting for or adjusting the pressure of test fluid in the cavity 42.

The flow regulator 20 comprises an electrical coil 60 which surrounds a magnetizable rocker 62 pivotally mounted about a pivot 64. Permanent magnets 66 are arranged at an end of the rocker 62 which is beyond the coil 60, to create a magnetic field, the lines of which extend transversely of the rocker 62.

Located around the rocker 62 on the side of the pivot 64 thereof which is further from the coil 60 is a hollow flexible walled housing 68 which forms a seal around the rocker 62 without preventing rocking of the rocker 62 about its pivot 64. Two inwardly directed opposing nozzles 70 are provided within the housing 66 are connected to cavities 72 and 74, connected respectively to the two nozzles 70.

These cavities 72 and 74 are in communication respectively with opposite sides of a slider 76 of a slide valve 78. The slider 76 is coupled to the end 80 of the rocker 62 which is further from the permanent magnet 66 via a spring 82.

Test fluid inlets 84 open into the cavities 72 and 74 respectively and test fluid outlet 86 provides an outlet from the interior of the housing 68. The outlet 86 is connected to the return line 23 of FIG. 1. The slide valve 78 is provided with an inlet 88 and outlet 90 connected respectively to the conduits 22 and 34. The inlet 88 and outlet 90 are in alignment with one another. A bore 92 through the slide 76 connects the outlet 90 to the inlet 88, and the effective available cross-section for test fluid passing through the bore 92 is determined to the extent to which the latter is in registration with the inlet and outlet 88 and 90, which in turn is dependent upon the axial position of the slide 76 within the slide valve 78.

Figure 3A:
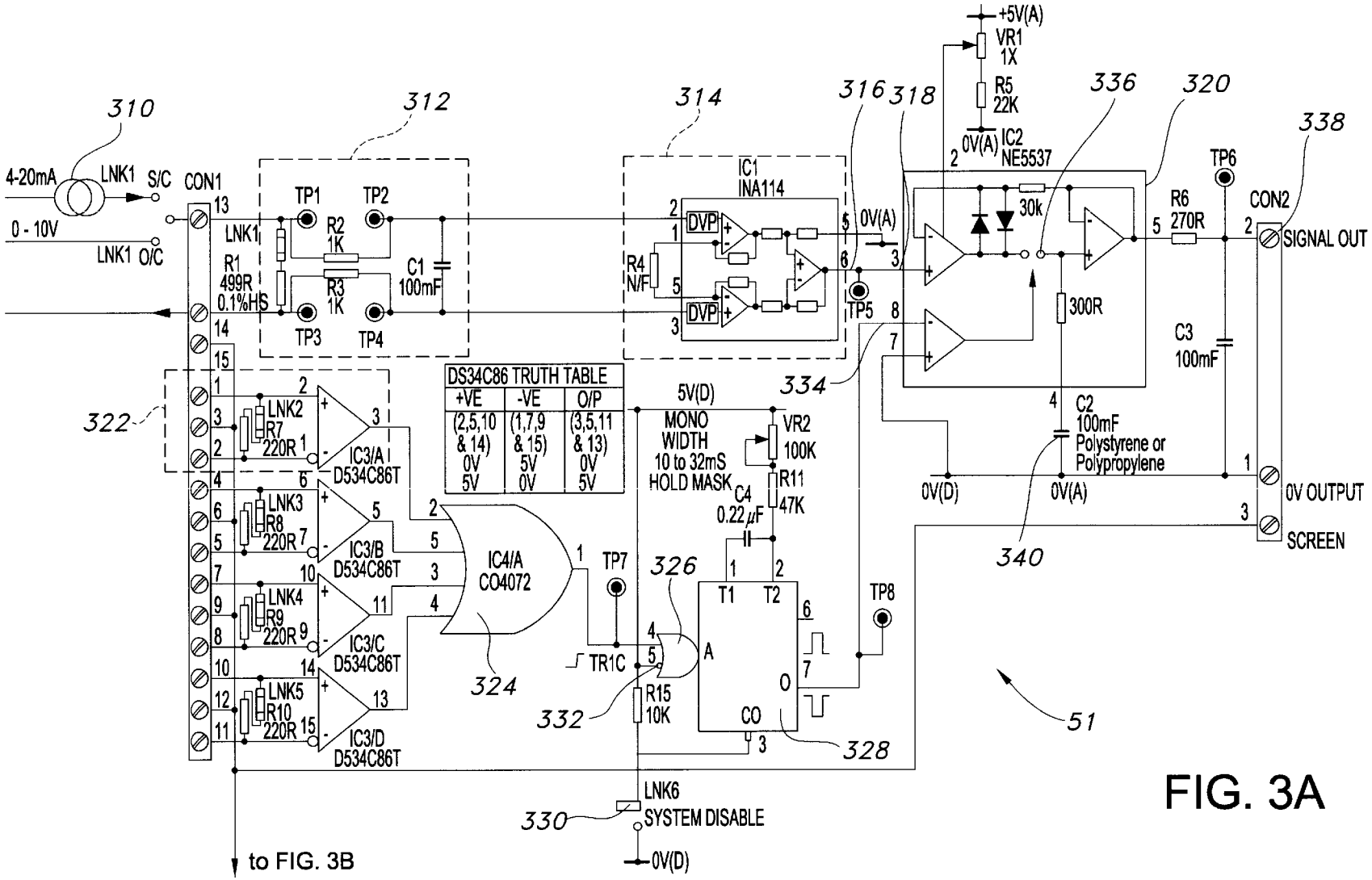
FIG. 3 shows in greater detail an electrical circuit diagram of a part of the circuitry shown in FIG. 2.
Figure 3B:
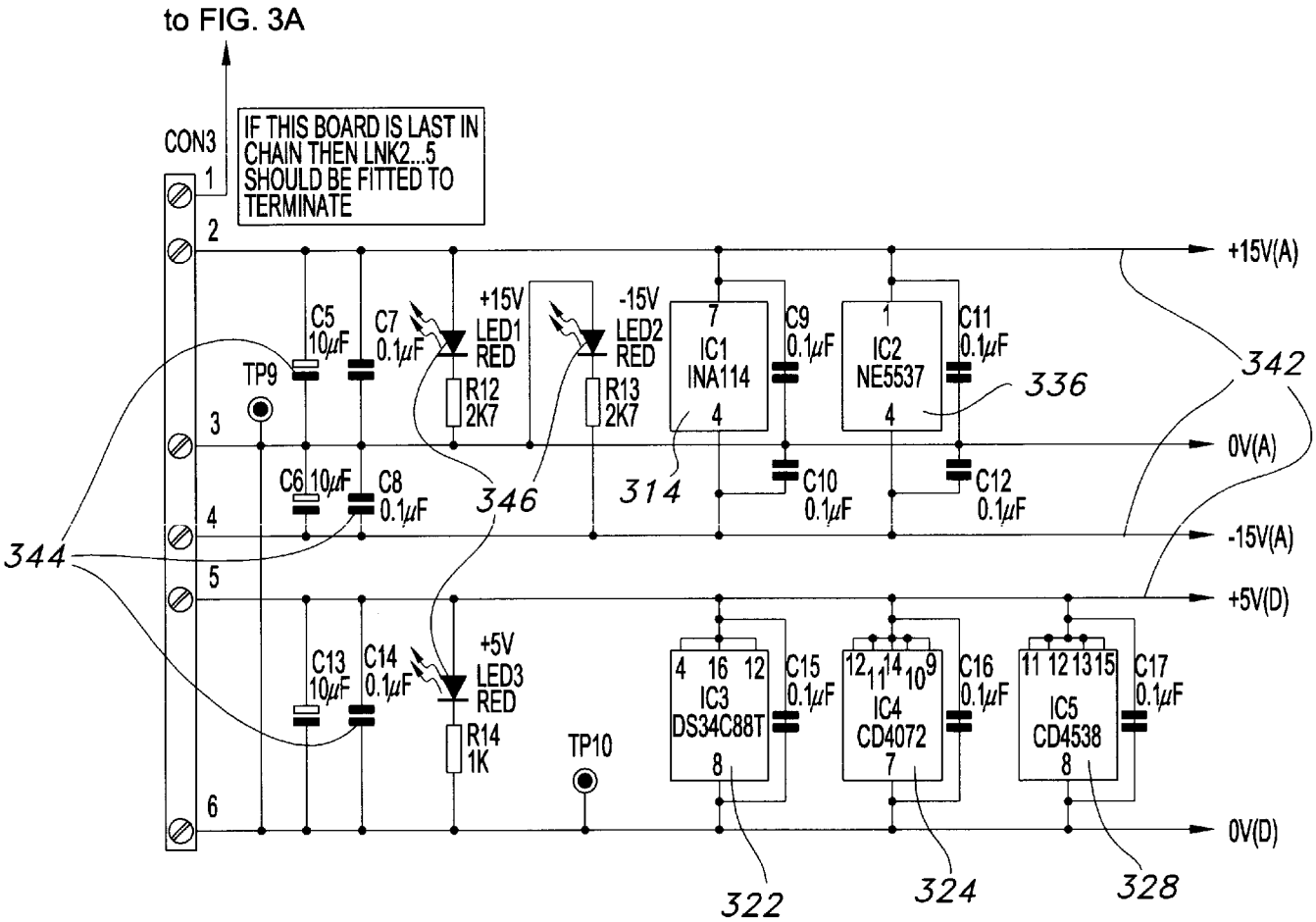

The pressure signal modifier 51 is shown in greater detail in FIG. 3. This shows an input 310 from the pressure transducer 49 in the form of a converter to bring the current levels to a desired range for this circuitry. This input 310 is connected to a low pass filter 312 to eliminate undesired noise on the signal. The output from the low pass filter 312 is connected to the input of a converter 314 to convert the signal to simple signals instead of complex variable ones at its output 316 which is connected to a first input 318 of a signal generator 320.

A signal converter 322 is connected to receive a signal from the processor 18 which triggers the injector valve 46. Three further such signal converters 322 are also shown in FIG. 3 which are available to enable the monitoring equipment to monitor up to four injector valves simultaneously.

The outputs from the signal converter 322 are fed to four respective inputs of an OR gate 324, the output from which is connected to an OR gate 326 of a monostable device 328. The latter is triggered by the leading edge of a signal input to the OR gate 326 from the OR gate 324. A system disable switch 330 is connected to a negating input 332 of the OR gate 326 to hold the input at a continuous high level so as to render ineffective any leading edge of a signal from the OR gate 324.

The Q-bar output of the monostable 328 is connected to a further input 334 of the signal generator 320. This input 334 is connected via a differential amplifier to close a switch 336 for the duration of a negative—going pulse from the Q-bar output of the monostable 328. The output signal at the output 338 of the pressure signal modifier 51 is determined by the voltage across a capacitor 340, which in turn is determined by the value of the signal to the input 310 at the time the switch 336 is closed, or, if the latter is open, at the time the switch 336 was last closed.

Power lines 342 also show how the devices 314, 336, 322, 324 and 328 are powered up. Smoothing capacitors 344 are provided on the power lines 342, as well as power indicating light emitting diodes 346.

Operation of the equipment is as follows. The injector 46 under test is secured to the head 36 by way of the connector 44. Test fluid from the tank 10 is pumped into the system by way of the pump 12 and air is purged from all cavities and conduits in the system. The pump is set to operate by the control processor 18 at a pressure slightly higher than the desired pressure for test fluid within the head 36. Test fluid is urged by the pump 12 into the conduit 22 so that it passes through the temperature controller 24 and the filter 26 to ensure that it has the right temperature and cleanliness, respectively. Test fluid continues from the conduit 22 through the flow regulator 20, the further filter 38, and the flow meter 40 before it reaches the test head 36. The control processor 18 operates the injector valve 46 so that the latter is caused to inject fluid into the collecting vessel 54 from the interior 42 of the test head 36.

The output from the flow meter 40 fed to the control processor 18 enables the latter to provide data output signals at its output 52 indicative of the volume of fluid discharged from the injector valve per injection. If desired or necessary, an adjustment may be made to the injector valve 46 by the control processor 18 via the injector valve adjuster 47 and the adjustment rod 48.

The temperature sensor 50 enables an adjustment to be made to the output data signals at the output 52 by the control processor 18 to compensate for any difference in temperature between the desired temperature and the actual temperature. It also enables the control processor 18 to transmit a control signal to the temperature control 24 to adjust the temperature of test fluid flowing therethrough and thereby bring the temperature in the test head 36 closer to the desired temperature.

In the event that the pressure in the test head interior 42 as indicated by the sensor 49 differs from the desired pressure, this is compensated for by the control processor 18, which detects this difference by virtue of the electrical connection it has with the pressure sensor 49, and changes its control output to the flow regulator 20 accordingly. The manner in which the flow controller 20 operates will now be described with reference to FIG. 2.

Pressurised test fluid from the conduit 22 is fed to the inlet 88, via the bore 92 to the outlet 90, the amount of flow through the bore 90 being determined by the extent to which the latter is in registration with the aligned inlet and outlet 88 and 90, respectively.

Pressurised test fluid from the conduit 22 is also fed through the inlets 84 to fill the cavities 72 and 74. Test fluid flows from the cavities 72 and 74, via the nozzles 70 within the housing 68 and out from the housing 68 via the outlet 86 from whence it is returned via the return line 23 to the tank 10. In the event that the electrical current through the coil 60 is increased, so as to magnetise the rocker 62 to a greater extent so that the end 62 thereof moves in the direction of the arrowhead shown adjacent thereto towards the right viewing in the direction of the diagram, a portion of the rod 62 immediately below the pivot 64 will then move closer to the nozzle 70 connected to the cavity 72 than it is to the other nozzle 70. This reduces the extent to which test fluid can now flow from the cavity 72, with the result that the pressure therein increases and urges the slider 76 in the direction of the arrow shown adjacent thereto towards the right viewing the apparatus in the manner shown in FIG. 2. This pulls the end 80 of the rocker 62 in the direction of the arrow shown adjacent thereto towards the right viewing the apparatus as in FIG. 2 so as to increase the flow of test fluid through the nozzle 70 connected to the cavity 72. Ultimately, a balanced position for the rocker 62 is achieved once again, but with the slider 76 moved further towards the right so that the force acting at the lower end of the rocker 62 compensates the force acting on the upper end of the rocker 62. A corresponding movement of the slider 76 in the opposite direction will follow a decrease in the current through the coil 60 and a momentary increase in the pressure of test fluid in the cavity 74. In this way the flow through the bore 92 is proportional to the current passed through the coil 60. A very rapid compensation to the flow through the regulator 20 to compensate for any change in pressure at the head 36 is thereby achieved by virtue of the hydraulic amplifier which includes the cavities 72 and 74.

It will be seen that the pressure signal modifier 51 ensures that the flow controller 20 only sees the pressure in the cavity 42 at the time a triggering signal is issued from the control processor 18 to operate the injector valve 46. At this point in time, the pressure of fluid in the cavity 42 is relatively undisturbed because shock waves from the opening of the injector valve 46 have not yet spread to its interior. The pressure signal modifier 51 achieves this in that the signal from the pressure sensor 49 is continuously present at the input 310. A measure of this signal in turn therefore appears continuously immediately to the upstream side of the switch 336. When a pulse arrives at the input 334 of the signal generator 320, as a result of a signal applied to the signal converter 322 (in turn triggering the OR gate 324 and the monostable 328), the voltage level across the capacitor 340 is set to the value of the voltage at the switch 336. Directly the pulse from the monostable 328 ceases, the switch 336 opens, and the voltage across the capacitor 340 remains at the value it had when the switch 336 was last closed. This therefore sets the value of the signal at the output 338 of the pressure modifier 51 at a value corresponding to the voltage across the capacitor 340.

In the event that a change in pressure is desired at the test head 36 during the course of the test procedure, the control processor 18 changes the electrical current delivered to the coil 60 of the flow regulator 20 and the flow regulator 20 speedily brings the value of the pressure of the test fluid in the test head 36 to the new desired pressure.

The illustrated equipment may provide the following advantages:

- Very fast transient response times so that pressure changes can be achieved in less than 0.5 seconds.
- Very accurate pressure control over a wide pressure range. Tests have shown control to better than +/−0.05% of value for both steady state and transient flow changes.
- Operation with low viscosity test fluids (this is outside the normal operating viscosity range for this type of valve).
- Insensitivity to pulsations caused by the injector.
- Insensitivity to flow changes caused by changes to the injector duty cycle.

Numerous variations and modifications to the illustrated equipment may occur to the reader without taking the resulting construction outside the scope of the present invention.

To give one example, a gas spring may be provided to dampen the oscillatory changes of the pressure of the test fluid in the interior 42 of the test head 36. The slide valve 78 may be in the form of a spool valve.

Another example of a modification would be the use of a pressure control valve with a return line when the injector is switched off to cope with any excess flow under those conditions.

In another example, the signal from the pressure signal modifier 51 may be issued intermittently, provided simply by allowing through the value of the signal at the input 310 only for a brief pulsed period when the injector valve is triggered, provided either the processor 18 or the flow regulator 20 are designed to hold that value in memory until a value is received of the next intermittent signal.

I claim:

1. Monitoring equipment comprising a part which defines a cavity, input means to input fluid under pressure into the cavity, mounting means on the part to enable a fluid release device to be connected to the part and to release fluid from the cavity intermittently when the system is in use, control means connected to issue a triggering signal to the fluid release device to cause the latter to release fluid from the cavity, and a pressure sensor coupled to the cavity to provide a measure of the pressure within the cavity, wherein the equipment further comprises pressure signal modifying means connected to receive signals from the pressure sensor and the control means and constructed to provide an output signal which is a measure of the pressure of fluid within the cavity at the time the control means issues the triggering signal, whilst the effect of signals from the pressure sensor received by the modifying means on the output signal therefrom at other times is obviated.

2. Monitoring equipment according to claim 1, wherein the input means of the monitoring equipment include an adjustable flow regulator which serves to regulate the input of fluid under pressure into the cavity.

3. Monitoring equipment according to claim 2, wherein the adjustable flow regulator comprises fluid flow control means coupled to the pressure sensor so that the fluid flow control means effects an increase or a decrease to the flow of fluid into the cavity, thereby to maintain the pressure of the fluid therein at a desired operating pressure.

4. Monitoring equipment according to claim 3, wherein the flow control means comprises an hydraulic amplifier arranged to operate valve means of the flow control means so as to effect such increase or decrease.

5. Monitoring equipment according to claim 3, wherein the flow control means comprises a first movable member, transducer means which serves to provide a force which acts on and moves the first movable member in dependence upon magnitude of an input signal delivered to the flow control means, two inputs connected to deliver pressurised fluid to opposite sides respectively of the first movable member and to opposite sides respectively of a second movable member, and output means from which fluid flows after it has reached the first movable member, in such a manner that movement of the first movable member in a first direction increases the resistance to flow of fluid from one of the two inputs to the said output means, so that pressure of fluid from that input urges the said second movable member in a given direction, whilst movement of the first movable member in a second direction, opposite to the first, increases the resistance to flow of fluid from the other of the said two inputs to the said output means, so that pressure of fluid from that other input urges the said second movable member in another direction opposite to the said given direction, the flow control means further comprising balancing means to balance the movement of the second movable member against said force, and valve means which are opened to an extent which is dependent upon the position of the second movable member, whereby the extent to which the valve means is opened is dependent upon magnitude of the input signal, so that the latter effects such increase or decrease.

6. Monitoring equipment according to claim 5, wherein the pressurised fluid delivered by the said two inputs is the pressurised fluid from the said input means.

7. Monitoring equipment according to claim 5, wherein the balancing means comprise a spring.

8. Monitoring equipment according to claim 5, wherein valve means of the flow control means is a slide valve.

9. Monitoring equipment according to claim 8, wherein the slide valve is a spool valve.

10. Monitoring equipment according to claim 1, wherein the pressure signal modifying means provides the output signal continuously to the adjustable flow regulator by holding the value it has at the time the control means issues the triggering signal until the time the control means issues a next triggering signal.

* * * * *